US006273314B1

(12) United States Patent
Promoli

(10) Patent No.: US 6,273,314 B1
(45) Date of Patent: Aug. 14, 2001

(54) PROCESS AND APPARATUS FOR STORAGE OF FIBER BAND BETWEEN OPERATING COMPONENTS OF SPINNING MACHINES

(75) Inventor: Johann-Christian Promoli, Ingolstadt (DE)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 0 days.

(21) Appl. No.: 09/706,187

(22) Filed: Nov. 3, 2000

Related U.S. Application Data

(63) Continuation of application No. 09/268,378, filed on Mar. 15, 1999.

(30) Foreign Application Priority Data

Mar. 17, 1998 (DE) ..... 198 11 497

(51) Int. Cl.[7] ..... B65H 20/00; B65H 23/18; D01H 5/32

(52) U.S. Cl. ..... 226/118.1; 19/240; 226/118.4; 226/4; 226/42

(58) Field of Search ..... 226/4, 42, 118.1, 226/118.3, 118.4; 19/240

(56) References Cited

U.S. PATENT DOCUMENTS

| | | | | |
|---|---|---|---|---|
| 3,539,085 | * | 11/1970 | Anderson | 226/42 X |
| 3,613,975 | * | 10/1971 | Knight | 226/42 X |
| 3,852,848 | | 12/1974 | Feller . | |
| 3,862,473 | | 1/1975 | Felix et al. . | |
| 4,007,866 | * | 2/1977 | Traise | 226/31 |
| 4,026,450 | * | 5/1977 | Giros | 226/42 |
| 4,026,724 | * | 5/1977 | Giros | 226/4 |
| 4,165,028 | * | 8/1979 | Doherty | 226/118.1 X |
| 4,272,185 | * | 6/1981 | Arai et al. | 226/118.1 X |
| 4,561,581 | * | 12/1985 | Kelly | 226/42 X |
| 4,703,431 | * | 10/1987 | Sako et al. | 19/240 X |
| 4,898,094 | * | 2/1990 | Doumoto et al. | 226/4 X |
| 5,377,385 | | 1/1995 | Jornot et al. . | |
| 5,392,977 | * | 2/1995 | Kato | 226/42 X |
| 5,713,106 | | 2/1998 | Dammig . | |

FOREIGN PATENT DOCUMENTS

| | | |
|---|---|---|
| 3031312 A1 | 4/1982 | (DE) . |
| 0799916 A2 | 10/1997 | (EP) . |
| 9832903 | 7/1998 | (WO) . |

OTHER PUBLICATIONS

English Language Abstract of WO 9832903, Not a publication.

* cited by examiner

*Primary Examiner*—Michael R. Mansen
(74) *Attorney, Agent, or Firm*—Dority & Manning

(57) ABSTRACT

A process and an apparatus for storing of a textile material between operating components of spinning mill machines, wherein a first driving device drives an operating component which delivers the material into a storage facility and a second driving device drives another operating component which removes the material from the storage facility. One of the operating components is a high-dynamically reacting component, and the other operating component is a low-dynamically reacting component. The purpose of the invention is to minimize the size of the storage facility and to simultaneously reduce the amount of stored material. This is accomplished in that the quantity of delivered and removed material at any given time is continually measured and a running difference between the two quantities is determined. Dependent upon either a positive or a negative difference from standard, the RPM of the motor (M1) of the driving device for the low-dynamically reacting component (AO1) is controllably adjusted.

15 Claims, 4 Drawing Sheets

PROCESS AND APPARATUS FOR STORAGE OF FIBER BAND BETWEEN OPERATING COMPONENTS OF SPINNING MACHINES

The present application is a Continuation Application of U.S. application Ser. No. 09/268,378, filed Mar. 15, 1999.

BACKGROUND OF THE INVENTION

The invention concerns a process for the storage of a textile fiber material between operational components of spinning mill machines. Within this process, a driving system drives an operational component which delivers fiber material to a storage facility and another drive system drives another operational component which removes the fiber material from the storage facility. One of the operational components is a high-dynamically reacting operational component, and the other is a low-dynamically reacting operational component.

Further, the invention concerns an apparatus for the storage of a textile fiber material between operational components of spinning mill machines. Within the apparatus, a drive system drives an operational component, which delivers the fiber material into a storage facility and another drive means of another operational component, which removes the fiber material from the said storage.

Also, a signal generator is installed for the determination of the quantity of fiber material. The signal generator is connected to a control for a drive system.

A stretch works (i.e., a draw frame) with band weight regulation is advantageously well known in stretch works operations. In this case, a constant drive and a highly dynamic drive system work together.

Should, however, such a stretch works be employed in carding or combing, an additional low-dynamic drive system is required.

For instance, where carding is involved, we have a situation where:

a) the delivery or the removal means show a low-dynamic operating drive system;

b) the band weight control for the stretch works has a high-dynamic operating drive system; and c) the band deposition, which is in optional connection with a can changer, functions with a constant speed drive system.

Without detriment to the operation, the items a) and c) can be exchanged, that is, the delivery or removal means can show a constant speed drive system and the band deposition a low-dynamic operating drive system. What has been presented are extracts from the multiplicity of variants of the arrangements of different drive systems.

In this respect, the drive system embraces the driver, the means of transmission of power, and the type of operational means in question, all of which take action upon the fiber material. The drive system includes, for instance, a motor with motor control (corresponding to a servo-motor) or a motor control device. A low-dynamic driving system is characterized by relatively great inertial mass or the employment of drives of slow reaction response. In such a case, upon changes of speed of rotation, relatively long reaction times arise for the driven operational component. On the other hand, the high-dynamic driving system is marked by a drive of relatively smaller inertial mass with a high degree of acceleration possibilities. In this case, upon change of rotational speed, short reaction time is characteristic of the driven operational component.

Finally, a constant speed operational drive system shows no change in rotational speed during operation. This applies to a subsequent band deposition, in which the stretch works is designed for constant speed. The drive systems are independent, that is, without any mechanical coupling, one to the other.

Fundamentally, it appears that the stretch works with band weight control can be employed as a high-dynamic drive system between operating components of a carding or combing machine and a band deposition, of which at least one has a low-dynamic reacting drive system.

To match together the low-dynamic reacting drive system and the high-dynamic reacting drive system, or the reverse, a storage means is necessary for moving the band, that is, fiber material running in transport. The storage means, or storage, must compensate for the temporary differences in the delivery of the fiber materials. In other words, the storage must compensate for the differences in the working speed of the operational components. Under these conditions of different speeds, no tensioning or break in the fiber material can occur in such storage.

This statement also has validity, if a carding or combing machine is run in combined operation with a regular stretch works. Again, this statement is generally true for machines of spinning mills, which, for technological reasons in the working of fiber material, couple a high-dynamic reacting drive system with a low-dynamic reacting drive system, or the reverse.

The above statement applies also, if a high-dynamic reacting drive system is to be coupled with a drive system of essentially constant running speed.

WO 92/05301 (referring to FIG. 7A) describes the installation of a storage between a stretch works and a can-press. A pair of rolls, as an operative component of the stretch works, delivers fiber band into the storage. The band is removed by means of a guide roll as an operative component of a can-press. The drive of the stretch works is independent of the drive of the can-press. Signal generators (light relays) are arranged in stepwise fashion vertically within the storage facility.

This system is expensive and complex. The light relays monitor a limited storage space for filling. Under or over stepping this threshold releases a signal. Intermediate quantities of the fiber band are not determined.

This is disadvantageous, since at intervening intervals no statement is possible as to the increasing or decreasing change of the content of the storage facility. A reaction by the system can only occur when a limit is overstepped, that is, in this case the reaction of a drive is released later than a quantity change begins. Therefore, the storage, as a whole, must be designed larger than is really necessary.

To go further, it is very expensive to install additional signal generators and to keep them in order. The signals of a signal generator are conducted to a control, which regulates the drive for the can-press. In order to avoid hunting between maximum "full condition" and "minimum full condition," a greater interval between the two levels must be assured so that the maximum-minimum signals will not cause disturbance.

For the storage of a relatively great quantity of fiber material, the storage facility, as described in the state of technology up to now, must possess a relatively large spatial extent. Considering the installation of the storage facility within a carding or combing machine or connecting a combination thereof to a controlled stretch works, there arises the necessity for a relatively large space requirement for such a storage facility. This is very disadvantageous.

SUMMARY OF THE INVENTION

Thus, in the case of spinning mill machines, for the installation of storage facilities for textile fiber material, a principal object of the present invention is to diminish the size of the storage facility and therewith, also the quantity of material stored.

Additional objects and advantages of the invention will be set forth in part in the following description, or may be obvious from the description, or may be learned through practice of the invention.

An embodiment of the invention indicates how the quantity of delivered fiber material to storage and quantity of removed fiber material from storage can be determined.

The quantity of delivered fiber material is determined by the counting of the signals of a signal generator. The generator is connected to a shaft of a drive system, which drives the operational component which delivers the fiber material.

Such an operational component can be, for instance, a delivering roll-pair or a removing roll-pair of a stretch works. The quantity of removed fiber material is determined by the counting of signals of another signal generator, which is connected to a shaft of a driver. The shaft of the driver drives the operational component which effects the removal. Such an operational component can be, for instance, an entry roll-pair of the band depository or a roll pair of the stretch works. These signals are transmitted to an electronic counter. The counter enumerates the incoming signals, whereby the two counter inputs are compared with a base preset value and the difference is transmitted as the counter total. Depending on a positive or negative counter total, the counter total regulates the motor control, so that the rotational speed of the motor for the low-dynamically working operational component is correspondingly adjusted. This can be prearranged so that a signal for the adjustment of the motor rotation speed is emitted when the counter total attains a preset threshold.

A plurality of preset thresholds can be installed, which the counter can overstep or understep, so that signals for the alteration of the rotational speed of the motor are transmitted. These signals permit the alteration of the rotational speed of the motor with varied controlled rates.

The method of operation of the counter can be set up so that a difference is created from at least two counter totals that are brought about at two successive times. This difference is then compared with a threshold and upon overstepping this threshold, a controlling adjustment of the motor rotational speed is effected.

There is also the possibility, upon requirement, to operate without a threshold, so that in such a case a difference in count is established. Proportional to this difference an adjustment to the rotational speed of the motor is made.

In a further embodiment, the possibility arises of establishing an expectancy of a future adjustment to the low dynamic drive system. This is achieved in that a quantity measurement of fiber material made by a device ahead (with respect to band motion) of the operational component is input as a material quantity measurement, which is employed to anticipate the reaction of the high-dynamic reacting drive. Such a forecast can be realized by programming a computer, which receives the appropriate signal and evaluates it.

The apparatus, in accord with the invention, to carry out of the process. In this apparatus, one signal generator is for the determination of the quantity of delivered fiber before the entry into the storage facility, and another signal generator is for the determination of the quantity of fiber material leaving the storage facility. Both signal generators are connected with a counter. The output of the counter communicates with a control for the regulation of a motor of the drive system. The system drives the low-dynamic operational component. The signal generator can be a digital absolute value device, or an incrementally programmed unit.

In accord with another variant, the purpose of the invention can be achieved therein. The quantity of delivered and simultaneously removed fiber material in the storage is continually measured and a difference from the two values is determined. Depending on a positive or negative difference as compared to a standard base value, the rotational speed of the motor of the drive system is correspondingly adjusted for the low dynamic operational component of the stretch works. This variant is advantageously employed when the storage facility is located between a drive system with an essentially constant operational speed and a high dynamic drive system of a spinning machine.

The drive system with an essentially constant operational speed delivers the fiber material to the storage. The drive system with essentially constant operational speed should not be adjusted as to rotational speed, in order to maintain the constant running speed, for instance, of the entry system of a carding process.

The high-dynamic driving system removes fiber material from storage. The high-dynamic driving system is, in the present case, comprised of a roll pair of a stretch works. In order to not disadvantage this highly dynamic part of the stretch works which possesses band weight regulation, no intervention of this process should occur. In order not to injure the limiting conditions, the change in rotational speed control is applied to that motor which serves as driver for the low-dynamic operational component of the stretch works. The low dynamic operational component of such a stretch works consists of the delivery roll-pair which is found therein. The rotational speed of this roll-pair is controllably adjusted.

Should a band deposition means be placed following the delivery roll-pair, then the two form a low-dynamic driving system. In such a case, the rotational speed of the band depository must be adjusted to run synchronously with the adjustment of the delivery roll-pair. Depending on the determined stored quantity, corresponding control will be exerted on the delivery roll-pair of the stretch works. With an adjustment in the low dynamic driving system of a stretch works, a resulting effect takes place on the quantity in storage.

In the case of both variants, the invention is not affected if, in the stretch machine, the stretching rolls are mechanically coupled or run by separate individual drives.

The advantages to be gained by the invention especially consist in that:

- the magnitude and direction of a quantity change in storage content as compared to a set value (or threshold) is continually visible;
- a minimizing of the storage facility content is possible;
- a suitable reaction of the operational component to a change in the quantity is possible;
- the storage facility is reducible in its spatial extent, the storage facility does not require any signal generator; and
- in the drivers for the operational components, signal generators already exist so that an additional savings in expense occurs.

BRIEF DESCRIPTION OF THE DRAWINGS

An example embodiment of the invention is presented in the drawings and with the help of the same, the invention is more closely described.

DETAILED DESCRIPTION

Figure 1:
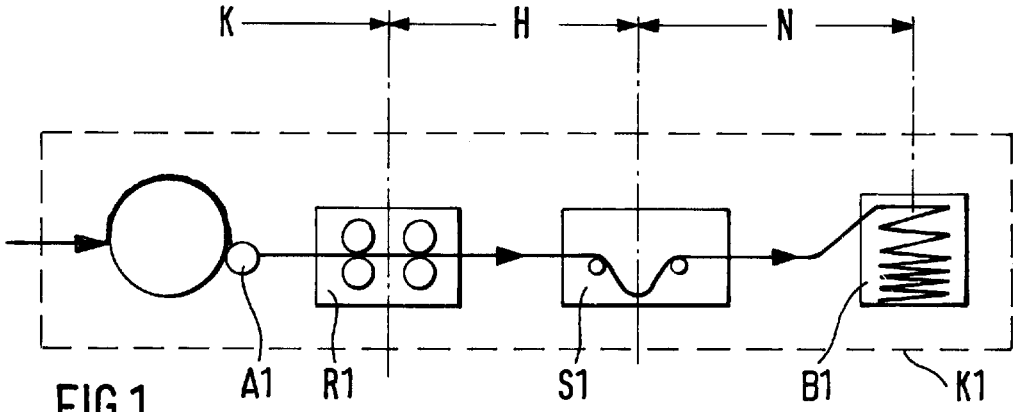
FIG. 1 shows a technological coupling by a storage facility of a high-dynamic drive system with a low-dynamic drive system of a carding machine.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield a still further embodiment. It is intended that the present application include such modifications and variations.

FIG. 1 shows as an example, the case of a carding system K1 in which the drive systems N, H, and K are independent of one another. In a carding system, operational components including stretch works, and storage or band depositories are integrated into the carding system itself. Such drive systems N, H, and K encompass the drive system, the power transmission means, and the necessary operational component which act upon the fiber material. The concept "fiber material" includes textile mattings, as well as fiber bands.

Also, a group of operational components can be driven by the driving system. This has no bearing on the function of the invention. In the interest of simplification, only specific operational components will be discussed in the following, in lieu of groups of operational components that make up a complete machine.

The depicted drive system K includes the fiber material source and feeder A1 to the operational equipment, as well as the entry rolls R1 of the stretch works which follow thereafter.

The drive system K can be, for instance, a drive system, the operational components of which work with an essentially constant speed of rotation, i.e., a constant processing speed. The fiber material source or feeder on a carding operation can, for example, furnish the fiber material at a constant rate. In the illustrated case of FIG. 1, a dynamic change of the input fiber speed is not typical.

Following drive system K, is drive system H. This system is concerned with the second roll pair (in some cases the following additional roll pair) of two roll pairs of the stretch works. This stretch works R1 is equipped with a band weight regulation. As to the drive system H it is a high-dynamic operating drive system. If the high-dynamic operating system H, delivers fiber material with a quickly changeable delivery speed, then this would cause problems for a subsequent drive system N with low dynamic drive behavior.

So it is necessary to install a storage means S1 for fiber material between the high-dynamic drive system H and the subsequent low-dynamic drive system N, which includes a band depository B1 and a storage means S1 for fiber material. This interpositioning is to provide the drive system N time to adjust to the changed delivery speed of the stretch works R1. The storage S1 is thus necessary, in order to compensate for the temporary change of delivery of the fiber materials, that is, the difference in the operational speed of the different operational components or groups of operational components. The feeder device A1 of the storage S1 works in unison with the delivery roll of the stretch works R1. The removal means of the storage S1 works in unison with the band depository B1.

Figure 1A:
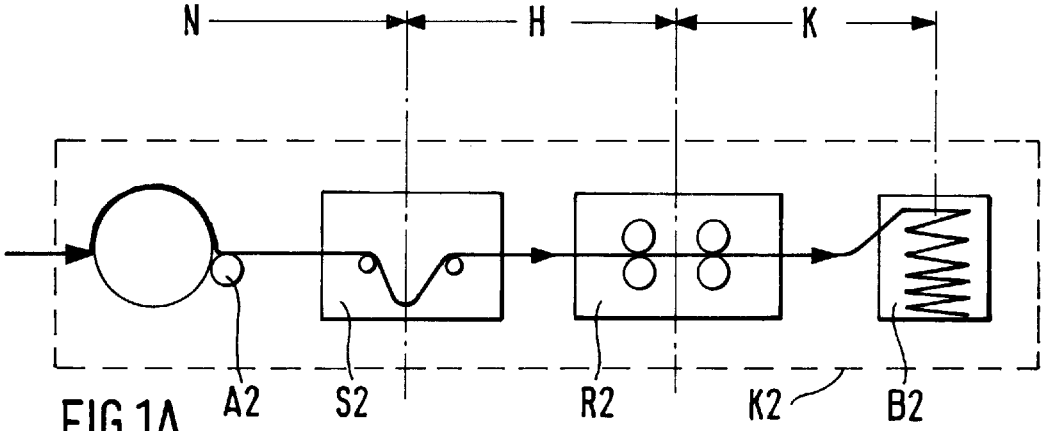
FIG. 1*a* illustrates another possibility of drive systems of a carding machine with storage.

There is another possibility for a carding operation K2 which is shown in FIG. 1A. This embodiment is namely that the drive system N with feed device A2 of the storage S2 is designed as a low-dynamic drive system. The drive system H with an entry roll-pair (one or more) of the stretch works R2 and the band weight regulation thereof is a high dynamic drive system. This stretch works R2 maintains on its exit roll pair (also known as, "delivery roll pair") an essentially constant running speed.

The drive system K with the exit roll pair of the stretch works R2 and the band depository B2 is in a drive system with a constant running speed. In the example of FIG. 1A, a storage facility S2 must be inserted between the low-dynamic drive system N and the high dynamic drive system H.

Figure 2:
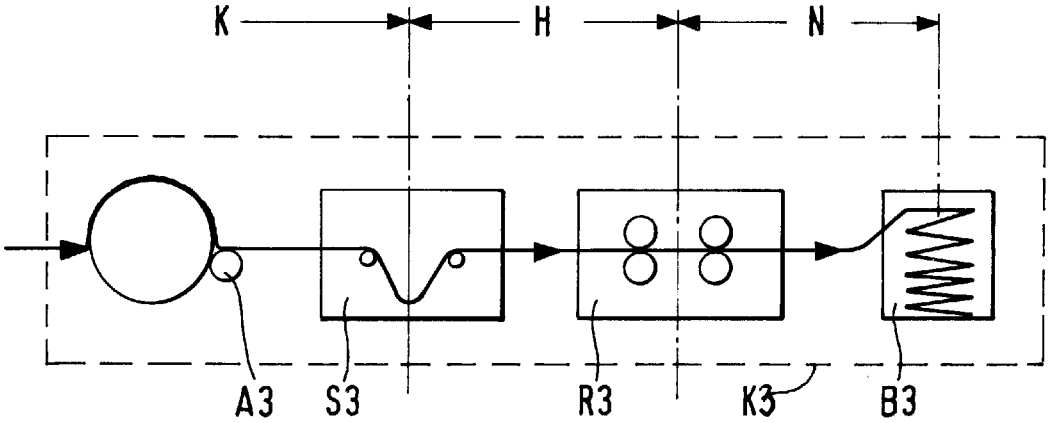
FIG. 2 shows a variant of technological coupling of a high dynamic drive system with a drive system of constant operational speed of the fiber material.

FIG. 2 shows the possibility of a technological coupling between a high dynamic drive system H, which is comprised of the intake roll pair R3 of a stretch works, and a drive system K, which operates at an essentially constant running speed of the fiber material. The illustrated drive system K of FIG. 2 is represented by the feed A3 in the case of a carding operation K3. The drive system N is low-dynamic and encompasses the exit roll-pair of the stretch works R3 along with the band depository B3. If the stretch works R3 is operated with a quickly changing input speed—i.e., referring to the entry roll pair—then the storage facility S3 must be inserted between the drive system K and the drive system H as shown in FIG. 2. With this background, it is reasonable to consider that because of the interposition of the storage operation, the high-dynamic drive system is not affected by additional changes in the speed of rotation of the storage operation.

Since the constant speed drive system K likewise cannot be allowed to be changed by adjustment, the possibility exists in the present case to change the delivery speed of the exit rolls of the stretch works R3 in synchrony with the band depository B3. In other words, the possibility exists to change the low dynamic drive system N. This means that a drive system is being changed which is not directly technologically associated with the storage. FIG. 2 thus presents, a different variant as compared to FIG. 1.

The invention is not limited to application on a carding operation or a combing machine. It encompasses also the connection between carding and/or combing machines and a regulated stretch works, or fundamentally, the connection of spinning machines which work fiber material.

The fiber material in the example is placed in the storage facility, in order to compensate for temporary differences in the delivery of the fiber material, that is, for temporary differences in the running speed of the operational components.

The storage of the fiber material is done only intermediately, since the delivered fiber material is continuously being removed. The content of the storage facility can be determined as a "quantity", which can be measured with the units applicable to weight (kg) or in units of length (for instance in cm). It is customary that the fiber material is stored in the storage facility in the form of band folds or loops. The storage facility is constructed as a container, which contains the loops, so that no damage nor deformation of the fiber material is possible.

For the present invention, the shape of the band depository plays no role. Any kind of band storage can be employed. The functioning of the storage is dependent on the operational component, which delivers fiber material into the storage. It will also be affected by that operational component which removes fiber material from the storage.

Figure 3:
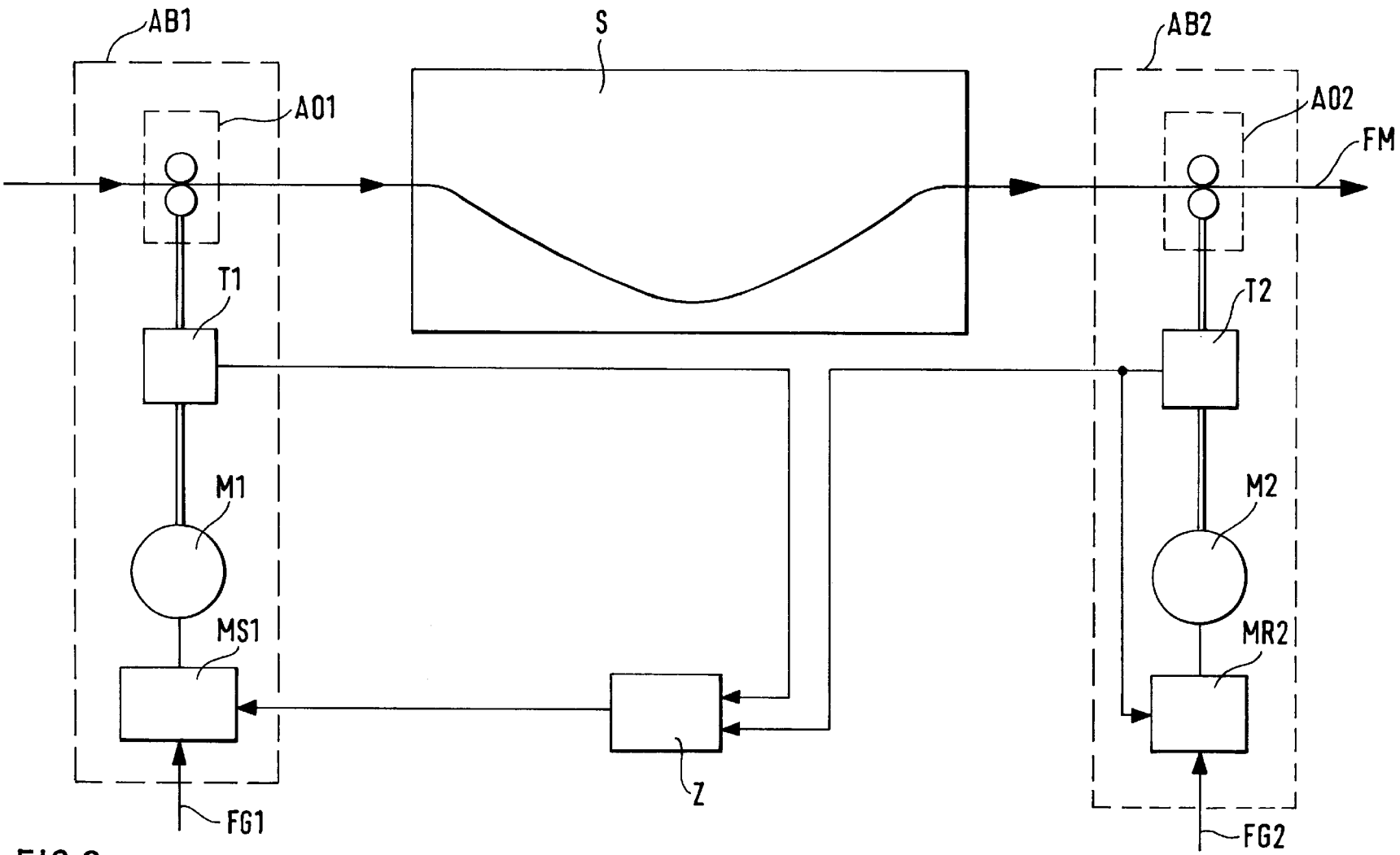
FIG. 3 shows an arrangement for the monitoring of a quantity change of the storage content.

FIG. 3 shows a storage S between a low dynamic drive system AB1 and a high dynamic drive system AB2. The storage facility, also called "Storage S", is so constructed that it stores the fiber material FM in the shape of a loop. The transport direction of the fiber material is indicated by the arrows. The low dynamic drive system AB1 encompasses as operation component AO1, a roll pair, between which rollers the fiber material is transported. The under roll of the roll pair is mechanically connected to a motor M1 through a power transmission means by the drive shaft of motor M1. The drive shaft of the motor is coupled with a signal generator T1. The signals of the signal generator T1 are a measure of the cumulative rotational angle of the shaft. Since an angle of rotation, or a rotation counter, can possibly be used, this signal generator can be made as an absolute value transmitter or an incremental impulse generator. With consideration of the mechanical power transmission means to the operational component AO1 and the geometrical relationships of the operational component AO1, the cumulative angle of rotation of the motor drive shaft is a measure of quantity units—that is, units of length or weight—of the transported fiber materials FM.

In the case of the low-dynamic drive system AB1, a low-dynamic drive system with an integral comparative means can be selected.

For instance, the motor M1 can be an asynchronous motor with a frequency changer. The frequency changer calls for a motor controller MS1. Motor M1 and the motor control MS1 form a drive system. The control signal command FG1 for the motor possesses the control signals, or this can be effected by an overriding control. In such a case, a signal generator T1 would be additionally installed to make possible a quantity count of the incoming fiber band. As an alternative, in an exchange, the motor control or even a motor regulation could be installed, in which case the signal generator T1 would then be part of the motor control.

For instance, the operational component AO1 can be the exit roll pair of a carding machine. From those rolls, the fiber material FM is transported to the storage S.

In the storage facility S, the fiber material FM is stored in band form as a loop. Advantageously, the storage S does not have to be equipped with a signal generator, as is a requirement of the present state of the technology. This omission carries with it a substantial savings in cost. It is, however, to be remembered that the installation of such a signal generator with a limit switch function provides an additional increase of operational security. From the storage S, fiber material FM is removed by means of an operational component AO2 which is part of a high-dynamic drive system AB2. Operational component AO2 corresponds, for instance, to an entry roll pair of a stretch machine with a band weight regulation. As a part of the stretch machine, the operational component AO2 belongs generally to a group of operational components, which are commonly driven by a drive means. In the present case, principally the operational component AO2 is presented as the entry roll-pair. However, it is permissible in this case again, that a single roll-pair is driven by an individual drive.

The fiber material FM is conveyed between the rolls of the operational component AO2 away from the storage S. The under roll of the roll-pair therein is driven by a drive system which is built around a motor M2. Advantageously, the motor M2 can be a servomotor.

This system possesses a control circuit comprised of a signal generator T2 and a motor control MR2. The signal generator T2 is to be found on the drive shaft of the motor M2. The signal generator can be based on the cumulative rotational angle principle (tachometer) or an incrementally actuated signal emitter. An absolute value sender has the advantage that, even in still-stand, a signal of the position of the shaft can be evaluated. Giving consideration to the mechanical means of transmission of power to the operational component AO2 and the geometric relationships of the operational component AO2, there is also the possibility that the cumulative rotational angle of the motor drive shaft is also a measure of the quantity (expressed in length or weight) for the transported material.

The signals delivered from the signal generator T2 are directed to a motor control MR2. This corresponds to a motor control circuit (servo amplifier) of the servo motor. The motor control circuit is provided with a control input which can issue from or through a superimposed control (for instance, the machine control). The signal generator T2 transmission has on its output side a branch, so that the signal to the motor control MR2 is also diverted to an electronic counter Z. The electronic counter Z receives not only the signal from generator T2, but also the signal from generator T1. It proves advantageous to use signal generators, which are integral with the motors and thus immediately available.

For the continuous determination of the quantity of delivered fiber material FM in storage and the continuous determination of the quantity of removed fiber material from storage, it is possible to arrange signal generators to produce a direct quantity measurement of the fiber material.

Since the direct cumulative angle of rotation of the two motor drive shafts are a measure of the unit quantities of the transported fiber material FM, then, by means of the counter Z, the quantity of delivered fiber material and the quantity of removed fiber material is continually enumerated. Thereby, the difference between delivered and removed fiber material can be continuously determined. This quantity, based on a starting quantity, represents the content in storage. Dependent upon this value, the rotational speed of the drive means for the low-dynamic operational component AO1 is accordingly adjusted. The rotational speed for the high dynamic operating component is not adjusted.

The quantity of delivered fiber material FM is determined by counting signals from the signal generator T1 that is connected to the drive shaft of a motor M1. This motor M1 drives the operational component AO1, which delivers the fiber material FM to the storage S. On the exit of the storage S, the fiber band is transported by a high-dynamic drive system AB2.

The drive means in the system are made up of a motor M2, a signal generator T2 which is placed on the drive shaft of the motor and also a motor control MR2. A motor/motor control package could also be used could also be used. The signal generator delivers the signal to the motor control MR2. The motor control MR2 regulates the operational characteristics of the servo motor M2.

The quantity of delivered fiber material FM is continually registered. To this end, the signal generator T1 sends its signals to a counter Z. At the same time, the counter Z receives signals from the signal generator T2, which it counts with a plus or minus to the count of T1. By means of the counter Z, the quantity of material delivered to and the quantity of material removed from storage S is continually available. The counter total represents the storage content. Depending on a positive or negative difference as compared to a set point of a basic content amount, the rotational speed of the drive means for the low-dynamic operational component AO1 is adjusted. A positive or negative difference represents, for instance, an increase or decrease of a preset basic fiber material content. The counter total at any one time can represent a preset basic amount. Thereby, a signal for adjustment of the rotational speed of the motor M1 is generated.

The fiber material FM must maintain a so-called base quantity in the storage facility. This base quantity must at least be present so that, in case of a stoppage in the drive system that temporarily leads to a diminution of the stored inventory, sufficient time is provided to the drive systems for a compensation of the rotational speeds. The counter total shows the difference of the stored fiber material FM as compared to a base quantity, that is, a preset value. The base quantity in storage will be set at zero. This provides the advantage that at any time, the size and direction of a quantity change as compared to an optional storage amount (base quantity) is visible.

The invention permits the rotational speed differences between delivery and removal, expressed either in amounts or time period units, to be held at a low level. Thus, a minimizing of the quantity of fiber material to be stored is achieved. In this way, it becomes possible to design the storage facility spatially small.

Figure 4:
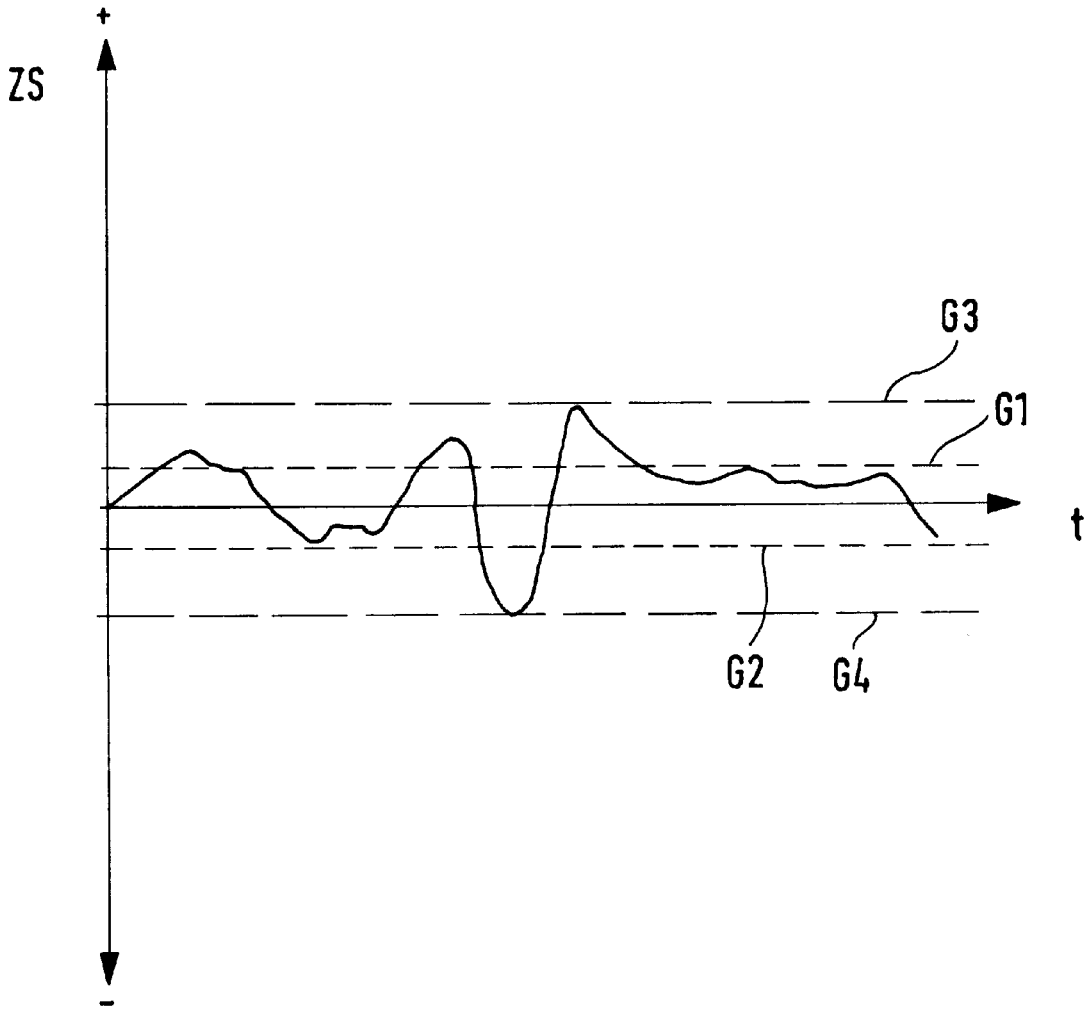
FIG. 4 shows threshold values of counter totals of a counter.

In a further embodiment, for the counter totals, several threshold values may be employed, the over or under stepping of which results in a signal for the adjustment of the rotational speed of the motor M1. The thresholds, in this case, are arranged at differently adjusted speeds. This provides the advantage that an adjustment of the motor M1 corresponding to the size of the quantity deviation is possible. Such an arrangement is unknown in the present state of the technology of the storage. The procedure is clearly explained in FIG. 4.

In that diagram, the counter total ZS is plotted against the duration of time t. Upon the counter total ordinate ZS, four threshold values are marked off. The thresholds G1 and G3 are in the positive area, i.e., addition to the quantity. The thresholds G2 and G4 are in the negative area, i.e., quantity depletion. The method of operation can be so ordered, that upon reaching the thresholds G1 or G2, the speed adjustment for the changing of the rotational speed is small. On the other hand, reaching the thresholds G3 or G4, the speed adjustment for the changing of the rotational speed of the motor M1 is great. The different rates of speed adjustment can be put into action by the motor control MS1.

By an informed choice and an ongoing optimization of the threshold values and adjustment speeds, the necessary storage inventory can be minimized.

Another embodiment for the adjustment of the motor M1 is found in that a difference in the counter total between two measuring points is determined. The difference represents the determination of the speed of fill of the storage. If this difference is overstepped, i.e., the gradient of the storage filling reaches a predetermined value, then the rotational speed of the motor M1 undergoes an additional adjustment to that adjustment made on the basis of the already established threshold.

This method of gradient formation operation can be carried out by programming technology in the motor control MS1. Using this gradient method, it is possible to react within a suitable time to quick, large quantity changes.

In another embodiment, signals are given that yield information regarding changes in the delivered quantities, for example, from the filling shaft or from the removal means of a carding machine. These signals can be used in a predictive way for the reaction of the high-dynamic drive. By this means, a leading adjustment of the Motor M1 can be introduced. Again, the invention allows the low-dynamic drive system to follow the high dynamic drive system very closely.

Figure 5:
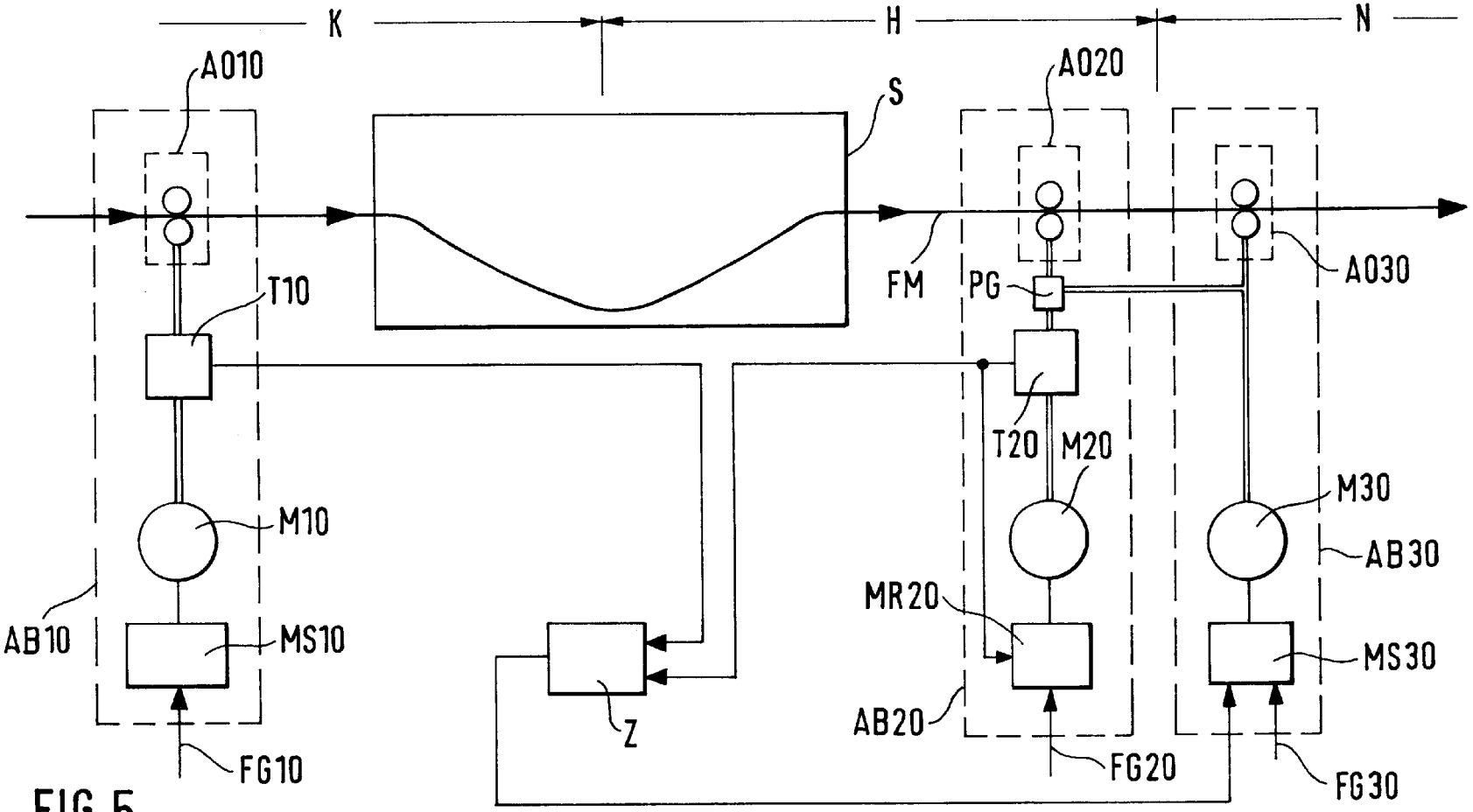
FIG. 5 shows a technological coupling of a drive system between an essentially constant operational speed drive system and a high-dynamic drive system.

FIG. 5 explains, in another embodiment, a case in which a storage facility is located between a drive system operating in essentially a constant processing speed and a high dynamic drive system. The drive system with an essentially constant processing speed, in the case of carding equipment, can be established by the input roll-pair on the carding machine itself. This input roll-pair delivers fiber material FM at a constant production speed. The high dynamic drive system is set up by the intake roll-pair of a stretch works having band weight control. In such a case, the surprising characteristic is that the speed of the entry roll-pair on the carding machine should not be affected. On the other hand, the high-dynamic operation of the entry roll-pair of the stretch works should not be disadvantageously acted upon.

In such a case, in order to act upon the quantity of the fiber material in storage, a bias on the delivery speed at the exit of the stretch works is proposed. The delivery speed is realized by the delivery roll-pair of the stretch works. The delivery speed of the delivery roll-pair is realized by means of the drive motor for the delivery roll-pair. Such a stretch works (draw frame) is known, in its mechanical construction, for instance, from a draw frame such as Type RSB 951 of the Firm RIETER Ingolstadt Spinning Machine Construction AG.

As FIG. 5 shows, the storage lies between an essentially constant speed drive system K and a high-dynamic drive system H. The drive system K is depicted by the drive system AB10, which presents, as the operational component AO10, the feed roll-pair. The drive system of the operational component AO10 encompasses the motor M10 with, for instance, a motor control MS10, which is provided with the motor input command FG10. The drive system AB20 is comprised of an operational component AO20, which represents the entry roll-pair of the stretch machine that latter has band weight regulation. The operational component AO20 is, for instance, driven by a servo motor M20, which has a signal generator T20 and a motor control MR20 (servo-amplifier). The motor input command FG20 for the motor regulation is provided as shown. The delivery roll-pair of the stretch works forms the operational component AO30. This component is responsible for the delivery speed of the fiber material FM. The operational component AO30 belongs to the drive system AB30, which in turn belongs to a low dynamic drive system N. The operational component AO30 is driven by a motor M30, which sets the base speed of rotation and thereby the delivery speed of the stretch works. This motor M30 is regulated by a motor control unit MS30, which is biased by motor input command FG30. The motor M30 is also designated as the, "Main Motor", since, as a result of mechanical coupling on the stretch works this motor provides the basic speed of rotation. The motor M20 is a regulated motor, which is mechanically coupled to a planetary gear system.

By this means, the stretching deformation is adjustable. Such a mechanical coupling on the stretch works is not compulsorily necessary. The function of the invention is again assured if the drives are independent electrical drives. The signals emitted by the signal generators T10 and T20 are conducted to the counter Z in the already described manner. The computed result of the counter Z is led as a signal to the motor control M30, in order to act upon the rotational speed of the operational component AO30. Thus, the delivery speed changes dependent upon the quantity of the storage quantity.

By means of the change of the delivery speed in the stretch works, indirect influence is brought to bear on the quantity of stored fiber material. This corresponds to a rotational speed change in the low dynamic drive system. For such a case, in which a band deposition means belongs to the low dynamic drive system N, this influence is to be synchronous.

It will be appreciated by those skilled in the art that various modifications and variations can be made in the present invention without departing from the scope of the invention. It is intended that the present invention include such modifications and variations as come within the scope of the appended claims and their equivalents.

What is claimed is:

1. A process for textile fiber material storage between operating components of spinning mill machines, the process comprising:

delivering textile fiber material by a delivering operating component of a spinning mill machine to a storage facility located between the delivering operating component and a removing operating component of the spinning mill machines;

removing the textile fiber material from the storage facility using the removing operating component;

wherein one of said delivering and removing operating components is driven by a high-dynamic drive system and the other of said delivering and removing operating components is driven by a low-dynamic drive system;

measuring simultaneously and continuously to quantify the delivered textile fiber material to the storage facility and the removed textile fiber material from the storage facility;

calculating continuously a difference value between the quantity measurement of the delivered textile fiber material to the storage facility and the quantity measurement of the removed textile fiber material from the storage facility; and measuring the difference value against a standard quantity value and using that measurement to control the low-dynamic drive system using a controller.

2. A process as in claim 1, wherein the storage facility is between said delivering operating component of the spinning mill machines, which delivers the textile fiber material at an essentially constant speed, and the operating component which is driven by the high-dynamic drive system.

3. A process as in claim 1, wherein the quantity measurement of delivered textile fiber material is determined by measuring signals of a signal generator disposable to a shaft of one of the high-dynamic and low dynamic drive systems which drives the delivering operating component delivering the textile fiber material, and the quantity measurement of removed textile fiber material is determined by measuring signals of a signal generator disposable to a shaft of the other of the high-dynamic and low dynamic drive systems which drives the removing operating component removing the textile fiber material.

4. A process as in claim 3, wherein the signals generated by the signal generators disposable to the shafts of the operating components which deliver and remove the textile fiber material are counted as count input using a counter which measures the count input against the standard quantity value that is preset.

5. A process as in claim 4, further comprising calculating the difference between the count input and the standard quantity value; and, depending on a preset threshold, accordingly adjusting the low-dynamic drive system by sending a signal from the counter to the controller of the low-dynamic drive system.

6. A process as in claim 5, further comprising adjusting the low dynamic drive system depending on a plurality of threshold values allowing for control of the rate of rotation at different rotational speeds.

7. A process as in claim 5, further comprising measuring the difference among at least two count inputs arising successively, and comparing that number against a threshold value to allow the rate of rotation to be controlled.

8. A process as in claim 7, further comprising measuring the difference among at least two count inputs arising successively, and comparing that number against a threshold value to allow the rate of rotation to be controlled proportional to the difference.

9. An apparatus for textile fiber material storage between operating components of spinning mill machines, said apparatus comprising:

a storage facility;

a feed operating component for feeding the fiber material to said storage facility;

a removing operating component for removing the fiber material from said storage facility:

a delivery operating component down stream of said removing operating component for delivering the fiber material from the spinning mill machine;

wherein said removing operating component is driven by a high-dynamic drive system and said delivery operating component is driven by a low-dynamic drive system;

a signal generator for determining the quantity of delivered fiber material disposed proximal to an entry of the storage facility;

a signal generator for determining the quantity of removed fiber material disposed proximal to an exit of the storage facility;

a counter to which both said signal generators are connected for calculating continuously a difference value between the measurements of said signal generators; and a controller to which said counter supplies said difference value for controlling said low-dynamic drive system for the respective operating component.

10. An apparatus as in claim 9, wherein said signal generator for determining the quantity of delivered fiber material is operationally configured with said feed operating component and said signal generator for determining the quantity of removed fiber material is operationally configured with said removing operating component.

11. An apparatus as in claim 10, wherein said feed operating component is driven by a constant drive system.

12. An apparatus as in claim 10, wherein said signal generators are absolute value devices or incremental generators.

13. An apparatus as in claim 9, wherein said storage facility is disposed between said feeding operating component of the spinning mill machines which delivers the textile fiber material at an essentially constant speed, and said removing operating component which is driven by the high-dynamic drive system.

14. An apparatus as in claim 13, wherein said motor for the low-dynamic drive system is an asynchronous motor.

15. An apparatus as in claim 9, wherein said low-dynamic drive system and said high-dynamic drive system are driven by motors.

* * * * *